US009180697B2

(12) United States Patent
Moriya et al.

(10) Patent No.: US 9,180,697 B2
(45) Date of Patent: Nov. 10, 2015

(54) RECORDING DEVICE

(71) Applicant: SEIKO EPSON CORPORATION, Tokyo (JP)

(72) Inventors: Yuki Moriya, Nagano (JP); Yoshitaka Shimada, Nagano (JP); Kazuma Ozaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/074,853

(22) Filed: Nov. 8, 2013

(65) Prior Publication Data

US 2014/0063110 A1 Mar. 6, 2014

Related U.S. Application Data

(62) Division of application No. 13/013,185, filed on Jan. 25, 2011, now abandoned.

(30) Foreign Application Priority Data

Mar. 3, 2010 (JP) ..... 2010-046019

(51) Int. Cl.
*B41J 29/38* (2006.01)
*B41J 13/00* (2006.01)

(52) U.S. Cl.
CPC ..... *B41J 13/0009* (2013.01); *B41J 29/38* (2013.01)

(58) Field of Classification Search
USPC ..... 347/16, 104, 164, 218, 220, 221, 262, 347/264; 100/172, 176, 331; 400/636, 637, 400/637.1, 637.3, 638, 639
See application file for complete search history.

(56) References Cited

U.S. PATENT DOCUMENTS

| | | | | |
|---|---|---|---|---|
| 5,874,979 | A * | 2/1999 | Ohyama | 347/104 |
| 6,729,720 | B2 * | 5/2004 | Miki et al. | 347/104 |
| 7,470,018 | B2 | 12/2008 | Miyazaki et al. | |
| 2005/0206959 | A1 | 9/2005 | Miyazaki et al. | |
| 2006/0197817 | A1 * | 9/2006 | Bedzyk et al. | 347/104 |
| 2006/0290762 | A1 * | 12/2006 | Uwagaki et al. | 347/104 |

FOREIGN PATENT DOCUMENTS

| | | | | |
|---|---|---|---|---|
| JP | 10-035939 | A | 2/1998 | |
| JP | 2005-144882 | A | 6/2005 | |
| JP | 2005-169749 | A | 6/2005 | |
| JP | 2005169749 | * | 6/2005 | B41J 13/00 |
| JP | 2007-326707 | A | 12/2007 | |

* cited by examiner

*Primary Examiner* — Hai C Pham
(74) *Attorney, Agent, or Firm* — Global IP Counselors, LLP

(57) ABSTRACT

The recording device includes recording unit for recording on a recording medium, conveying unit for conveying a recording medium upstream of the recording unit in the downstream direction, and an ejection unit for ejecting the recording medium which is downstream of the recording unit and which has undergone recording. The ejection unit has a drive roller and a driven roller urged toward the drive roller, the driven roller is capable of switching between a state of being urged by a first load and a state of being urged by a second load that is lower than the first load, the driven roller is set to the first-load selected state at least during rear end recording in which recording is performed on a rear end region of the recording medium, and the driven roller is set to the second-load selected state during ejection when the recording medium is ejected.

7 Claims, 6 Drawing Sheets

RECORDING DEVICE

CROSS-REFERENCE TO RELATED APPLICATIONS

This is a divisional application of U.S. patent application Ser. No. 13/013,185 which claims priority to Japanese Patent Application No. 2010-046019 filed on Mar. 3, 2010. The entire disclosure of Japanese Patent Application No. 2010-046019 is hereby incorporated herein by reference.

BACKGROUND

1. Technical Field

The present invention relates to a recording device which is typified by a fax machine, a printer, or the like, and particularly relates to a recording device in which the load of a driven roller can be switched for ejection unit provided downstream of recording unit.

2. Related Art

Inkjet printers in particular are described hereinbelow as examples of recording devices. A roller pair composed of a drive roller formed from rubber or another elastic material and a driven roller (a toothed roller) having teeth in the outer periphery is sometimes used as the paper ejection unit provided downstream of the recording unit in an inkjet printer. The reason a driven roller having teeth in the outer periphery is used is to prevent the ink from transferring because the roller comes in contact with the recording surface on which the ink is discharged.

Some inkjet printers are capable of performing edgeless recording in which recording is performed without leaving any white space on the four sides of the paper. In this type of inkjet printer, after the rear end of the paper has left the conveying roller upstream of the recording head, edgeless recording is performed on the rear end region including the rear end of the paper while the paper is fed by the ejection unit.

Particularly in cases in which the paper is cut into sheets of paper, when the rear end of the paper leaves the conveying roller upstream of the recording head, there are fewer roller pairs sandwiching the paper, the rear end of the paper rises upward readily, and there is a risk that the paper quality will suffer. Therefore, there are also cases in which two roller groups are provided in the paper conveying direction as the ejection unit, and the paper is sandwiched by these two roller groups, thereby preventing the rear end of the paper from rising upward during recording on the region at the rear end of the paper.

Furthermore, depending on the recording device, there are those which are configured so that the contact load (the load when the paper is nipped) of the driven roller (a toothed roller) on the drive roller can be varied, and are also configured so that the contact load is adjusted according to the ink discharge quantity, as shown in Japanese Laid-Open Patent Publication No. 2007-326707. According to this recording device, for example, the contact load can be reduced for a recording region having a large ink discharge quantity, the contact load can be increased for a recording region having a small ink discharge quantity, and the risk of the driven roller (a toothed roller) leaving traces of contact on the recording surface can be reduced. Japanese Laid-Open Patent Publication No. 2005-169749 discloses a recording device which switches between a knurl roller and a runner roller depending on the type of paper.

SUMMARY

However, when recording is performed on the region at the rear end of the paper and the contact surface is merely reduced, the paper cannot be reliably nipped and there is a risk of reduced conveying precision. On the other hand, when the contact surface is merely increased, the driven roller (a toothed roller) more readily leaves traces of contact on the recording surface.

Additionally, depending on the inkjet printer, there are those in which a suction groove for holding the paper by air suction is formed in a paper support part for supporting the paper supplied to the recording performance region, in order to stabilize the orientation of the paper when recording is being performed. In this type of inkjet printer, the paper conveying force must be increased when the paper is being suctioned and the contact load must be increased, the result of which is that the driven roller (a toothed roller) even more readily leaves traces of contact on the recording surface.

The present invention was devised in view of such circumstances, and an object thereof is to provide a recording device in which the driven roller is prevented as much as is possible from leaving traces of contact on a recording surface while recording on a region at the rear end of the paper is being appropriately performed.

To achieve the object described above, a recording device according to a first aspect of the present invention includes a recording unit, a conveying unit, and an ejection. The recording unit is configured to perform recording on a recording medium. The conveying unit is configured to convey the recording medium downstream, the conveying unit being provided upstream from the recording unit in a conveying route through which the recording medium is conveyed. The ejection unit is configured to eject the recording medium on which recording has been performed, the ejection unit being provided downstream from the recording unit in the conveying route. The ejection unit has a rotatably driven drive roller and a driven roller urged toward the drive roller with the driven roller being configured to be capable of switching between a state of being urged toward the drive roller by a first load and a state of being urged by a second load which is less than the first load. In a load-switching mode, the driven roller is switched between a first-load selected state during rear end recording in which recording is performed on a rear end region including a rear end of the recording medium when at least the rear end of the recording medium has left the conveying unit and is being conveyed by the ejection unit, and a second-load selected state during ejection in which the recording medium on which recording has been performed is ejected after the rear end recording has finished.

According to the present aspect, the driven roller provided to the ejection unit is configured to be capable of switching between a first load (hereinbelow sometimes referred to as the "high load" for the sake of convenience) and a lesser second load (hereinbelow sometimes referred to as the "low load" for the sake of convenience), and the first load (the high load) is selected during rear end recording in which recording is performed when at least the rear end of the recording medium has left the conveying unit and is being conveyed by the ejection unit, while the second load (the low load) is selected after the rear end recording has finished; therefore, the time during which the first load (the high load) is selected can be minimized, and the formation of contact traces by the driven roller in the recording surface can be suppressed to a minimum while reliable conveying is guaranteed and recording quality is maintained during rear end recording.

In the recording device according to a second aspect, in a load-maintaining mode, the driven roller is preferably set to the first-load selected state at least during the rear end recording and the driven roller is kept in the first-load selected state to eject the recording medium after the rear end recording has finished. The load-switching mode and the load-maintaining mode are preferably switched according to the type of recording medium.

Depending on the type of the recording medium, there are cases in which the driven roller does not readily leave contact traces in the recording surface, or contact traces are formed but are inconspicuous. In the present aspect, since the load-switching mode and the load-maintaining mode are switched according to the type of recording medium, the load-switching action is made unnecessary and a high throughput can be achieved by selecting the load-maintaining mode in accordance with the type of recording medium.

The recording device according to a third aspect preferably further includes a recording medium support unit configured to support the recording medium in a position facing the recording unit. The recording medium support unit preferably has a suction hole for applying suction force to a reverse surface of the recording medium and holding the recording medium by suction. The suction of the recording medium via the suction hole is preferably turned off at least when the second load is selected.

According to the present aspect, with the suction hole which is formed in the recording medium support unit for supporting the recording medium and which applies suction force to the reverse surface of the recording medium and holds the recording medium by suction, since the suction of the recording medium via the suction hole is turned off at least when the second load (the low load) is selected, this suction holding does not inhibit the ejecting of the recording medium by the driven roller, and the recording medium can be reliably ejected even when the driven roller is in the second-load (low-load) selected state.

In the recording device according to a fourth aspect, the ejection unit preferably includes a first roller group and a second roller group. The first roller group includes a plurality of roller pairs, each including a drive roller and a driven roller, disposed at prescribed intervals along a direction orthogonal to the conveying direction. The second roller group includes a plurality of roller pairs, each including a drive roller and a driven roller, disposed at prescribed intervals along a direction orthogonal to the conveying direction, the second roller group being provided downstream of the first roller group. A state occurs at least when the second load is selected in which the driven rollers of the first roller group and the driven rollers of the second roller group are disposed alternately along the direction orthogonal to the conveying direction.

According to the present aspect, since at least when the second load (the low load) is selected a state occurs in which the upstream driven rollers and the downstream driven rollers are disposed alternately along the direction orthogonal to the conveying direction, i.e., so that their positions in the direction orthogonal to the conveying direction do not coincide, the formation of contact traces by the driven rollers on the recording surface when the second load (the low load) is selected can be more reliably suppressed.

In the recording device according to a fifth aspect, the ejection unit includes a primary roller pair, a secondary roller pair, a first roller group, and a second roller group. The primary roller pair has a first driven roller urged by the first load and a second driven roller urged by the second load, and switches between a state in which the drive roller and the first driven roller constitute a pair and a state in which the drive roller and the second driven roller constitute a pair. The secondary roller pair has only a first driven roller and switches between a state in which the drive roller and the first driven roller constitute a pair and a state in which the first driven roller is separated from the drive roller. The first roller group includes the primary and secondary roller pairs disposed sequentially in prescribed intervals along a direction orthogonal to the conveying direction. The second roller group is provided downstream of the first roller group and includes a plurality of the primary roller pairs and the secondary roller pairs disposed sequentially in prescribed intervals along the direction orthogonal to the conveying direction. At least when the second load is selected, a state occurs in which the second driven rollers of the first roller group and the second driven rollers of the second roller group are disposed alternately along the direction orthogonal to the conveying direction.

According to the present aspect, since a state occurs at least when the second load (the low load) is selected in which the upstream driven rollers and the downstream driven rollers are disposed alternately along the direction orthogonal to the conveying direction, i.e., so that their positions in the direction orthogonal to the conveying direction do not coincide, the formation of contact traces by the driven rollers on the recording surface when the second load (the low load) is selected can be more reliably suppressed.

In the recording device according to a sixth aspect, at least when a switch is made from the first-load selected state to the second-load selected state in the load-switching mode, the load selection state of one of the first roller group and the second roller group is preferably switched first.

According to the present aspect, at least when a switch is made from the first-load selected state to the second-load selected state in the load-switching mode, since the load selection state of either one of the first roller group and the second roller group is switched first, it is possible to avoid the occurrence of a state in which the recording medium is not nipped on either one of the first roller group or the second roller group. It is thereby possible to prevent the rear end of the recording medium from rising upward and coming in contact with the recording unit.

In the recording device according to a seventh aspect, at least when a switch is made from the first-load selected state to the second-load selected state in the load-switching mode, the load selection state of the first roller group is preferably switched first.

According to the present aspect, at least when a switch is made from the first-load selected state to the second-load selected state in the load-switching mode, since the load selection state of the first roller group is switched first, it is possible to avoid states in which the recording medium is nipped only by the second roller group when the second roller group, which is farther from the recording unit, is under the second load (the low load). It is thereby possible to prevent the rear end of the recording medium from rising upward and coming in contact with the recording unit.

In the recording device according to an eighth aspect, during recording until the rear end of the recording medium leaves the conveying unit, the driven roller is preferably separated from the drive roller.

According to the present aspect, since the driven rollers can be separated from the drive rollers during recording until the rear end of the recording medium leaves the conveying unit, the driven rollers can be reliably prevented from damaging the recording surface of the recording medium during recording until the rear end of the recording medium leaves the conveying unit.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention is described hereinbelow with reference to the drawings.

Figure 1:
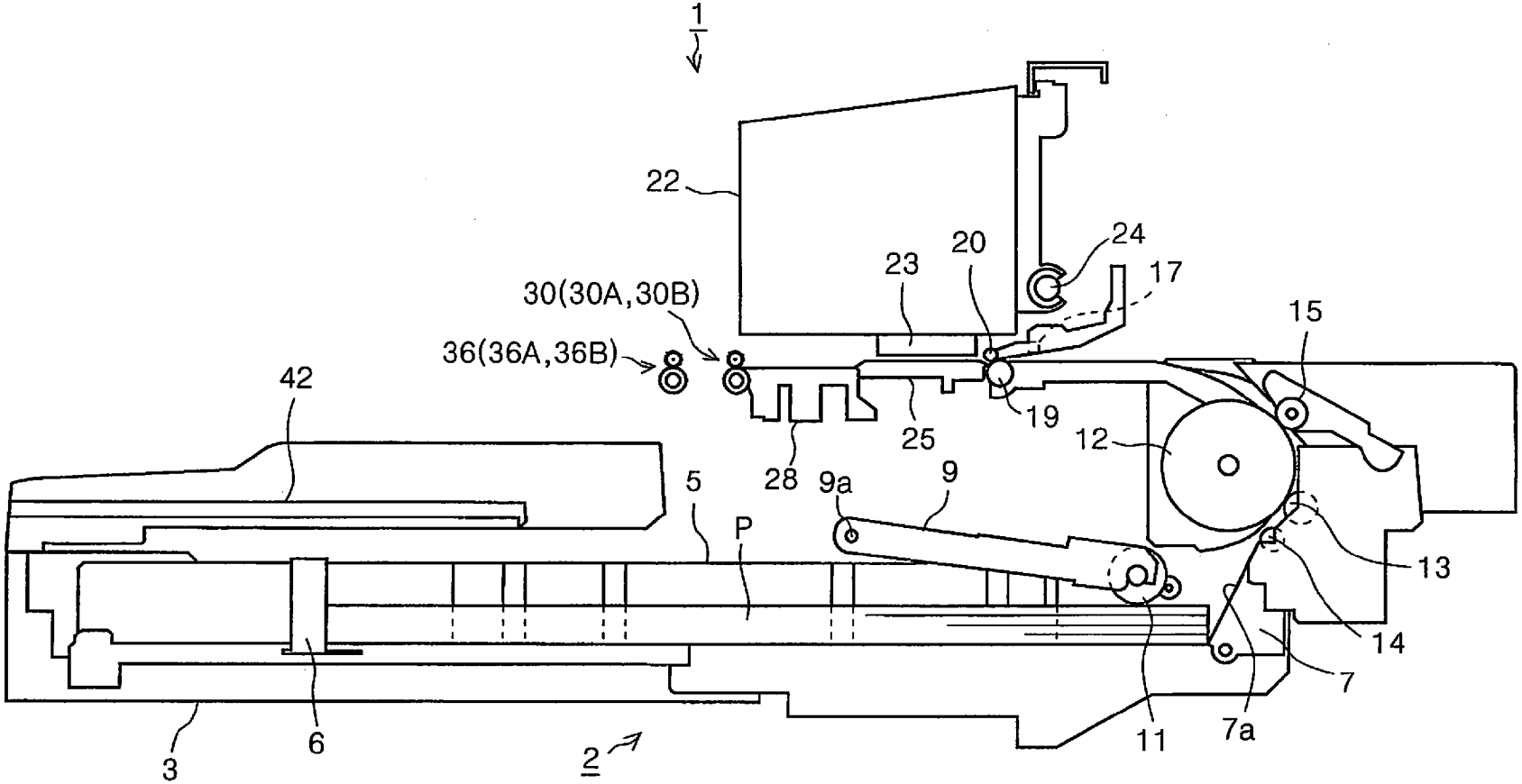
FIG. 1 is a cross-sectional schematic side view of an inkjet printer according to the present invention.
Figure 2:
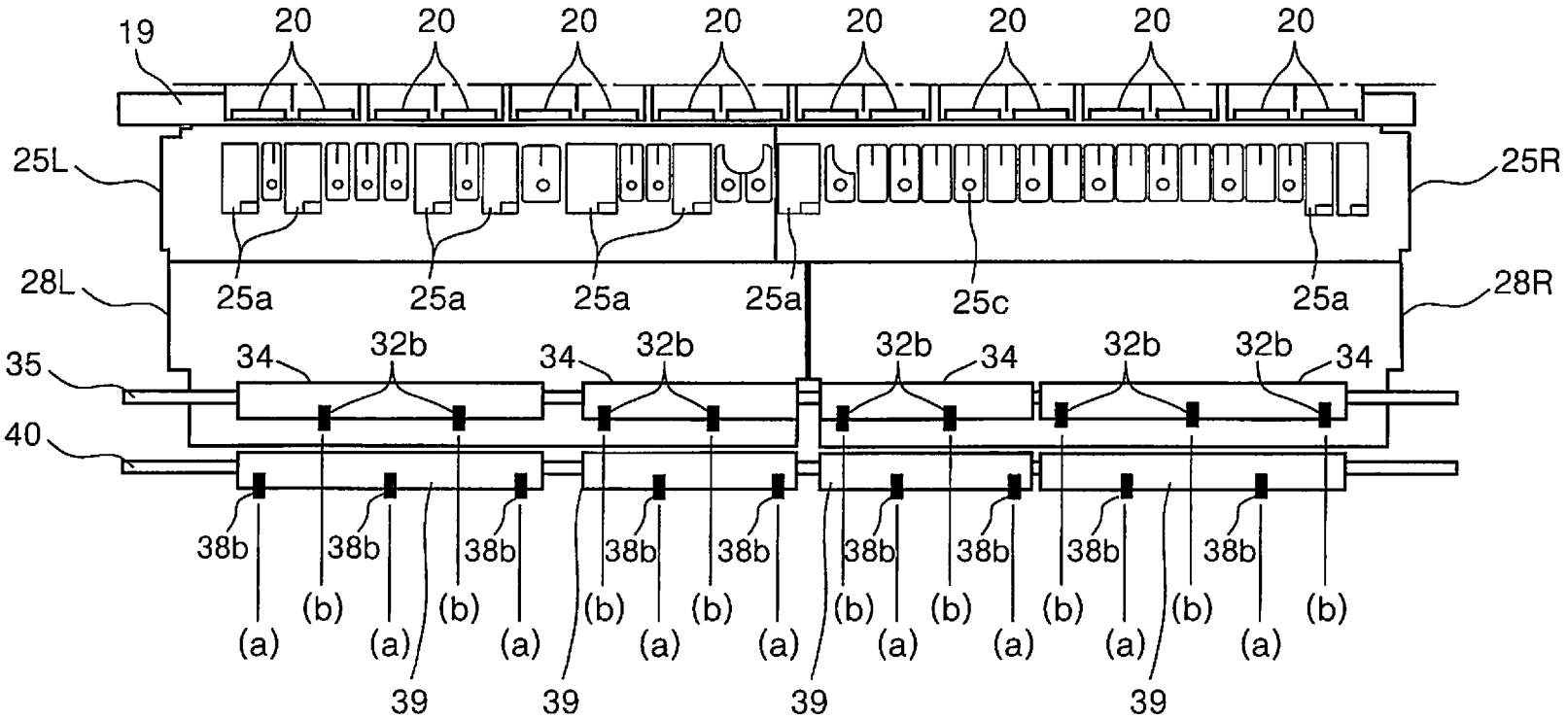
FIG. 2 is a plan view of the recording performance region of the inkjet printer according to the present invention.
Figure 3A:
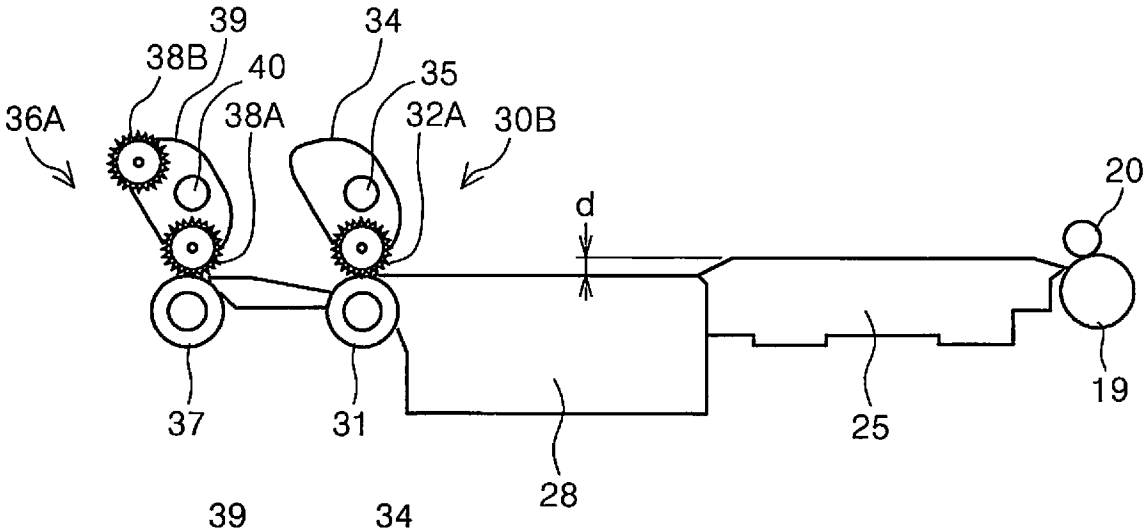
FIGS. 3A and 3B are side views of the first and second medium ejection unit (high-load selected state)
Figure 3B:
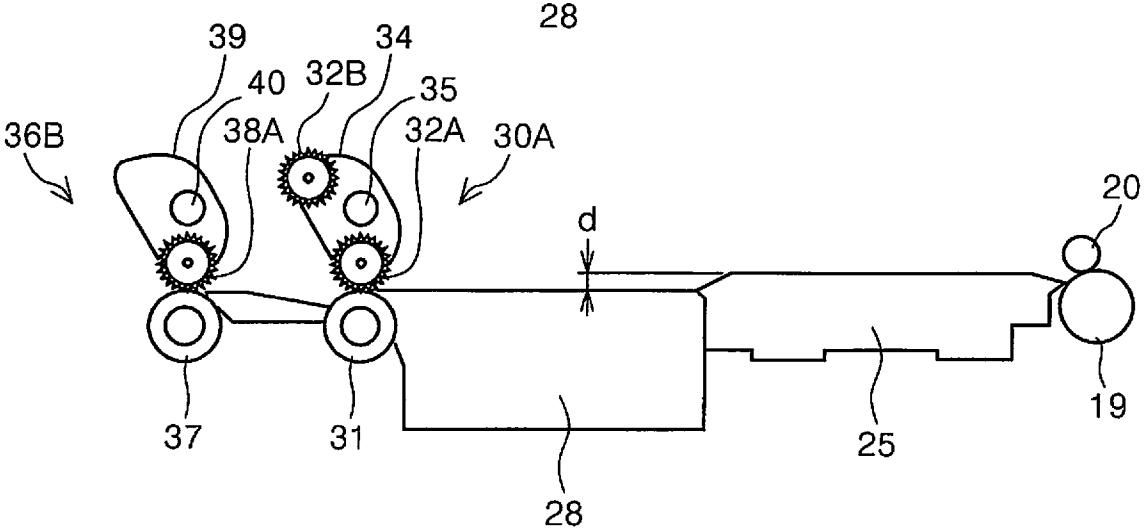
Figure 4A:
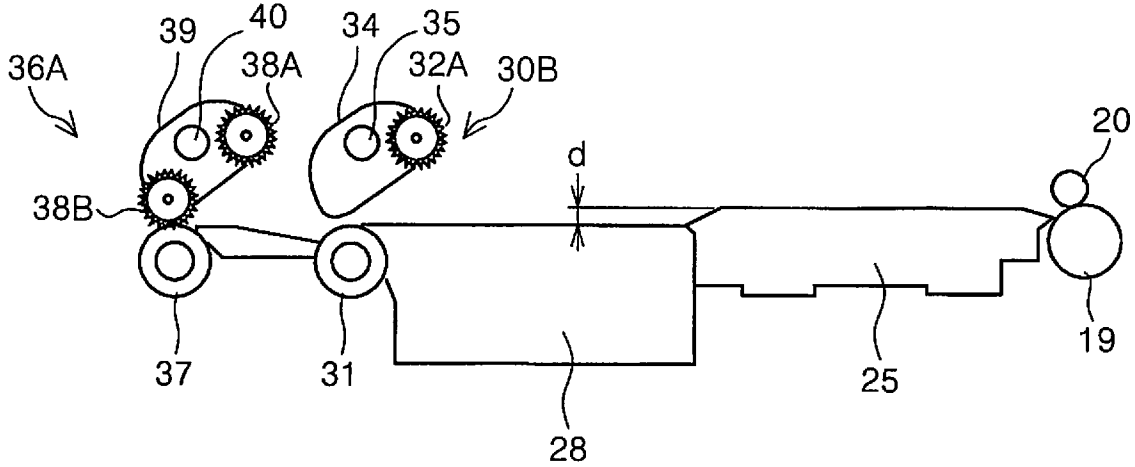
FIGS. 4A and 4B are side views of the first and second medium ejection unit (low-load selected state)
Figure 4B:
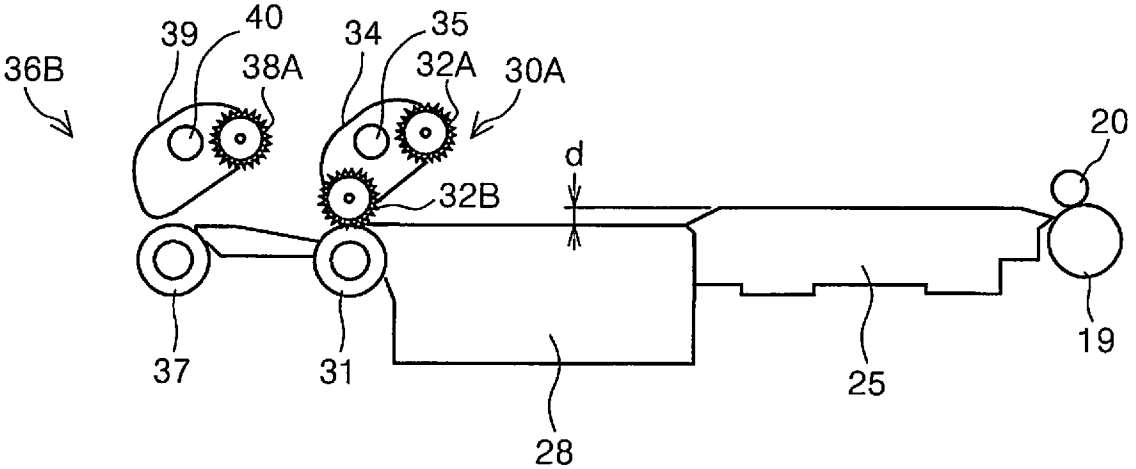
Figure 5A:
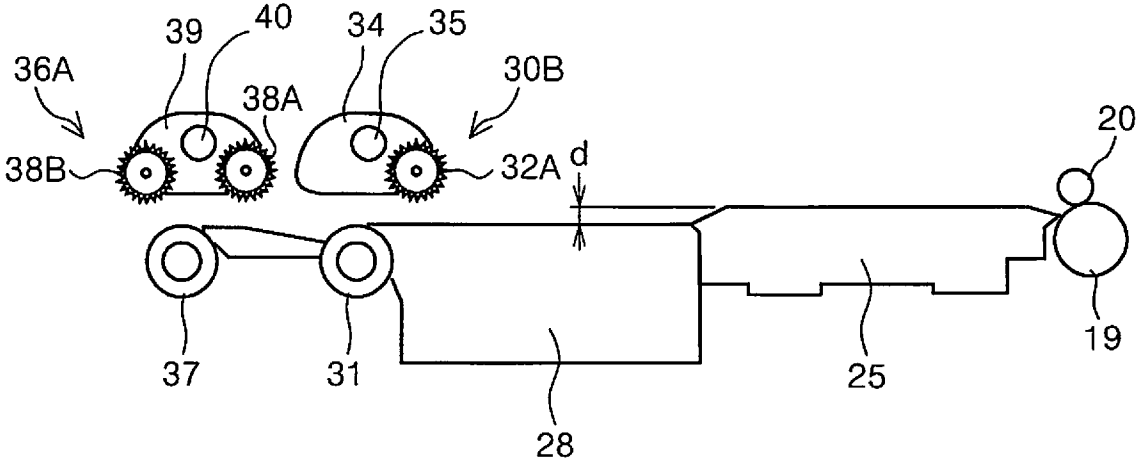
FIGS. 5A and 5B are side views of the first and second medium ejection unit (release selected state)
Figure 5B:
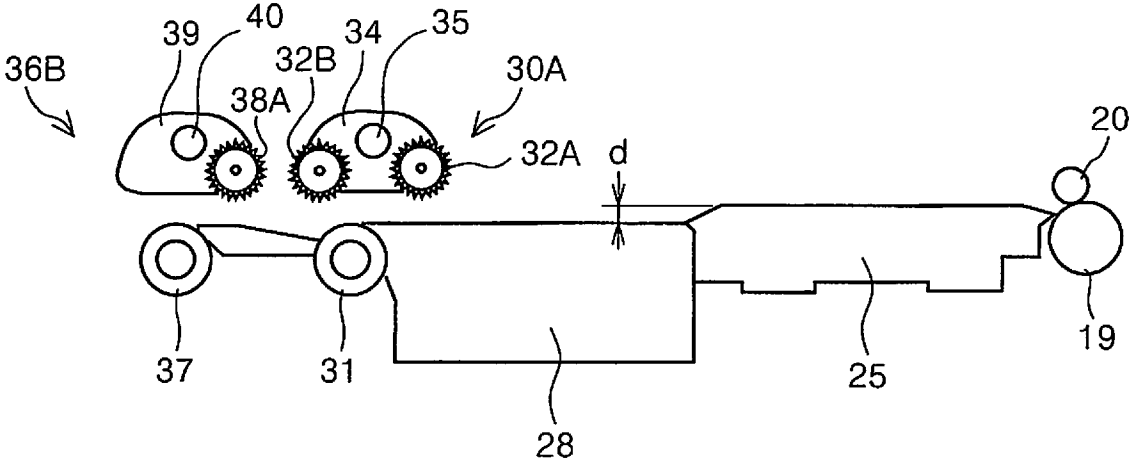

FIG. 1 is a cross-sectional schematic side view of a paper conveying route of an inkjet printer 1 in one embodiment of a liquid ejection device or a recording device according to the present invention, FIG. 2 is a plan view of the recording performance region, and FIGS. 3A and 3B through FIGS. 5A and 5B are side views of a first medium ejection unit 30 as the "first roller group" and a second medium ejection unit 36 as the "second roller group," wherein FIGS. 3A and 3B show a state in which the high load as the "first load" has been selected, FIGS. 4A and 4B show a state in which the low load as the "second load" has been selected, and FIGS. 5A and 5B show a state in which release has been selected.

Figure 6:
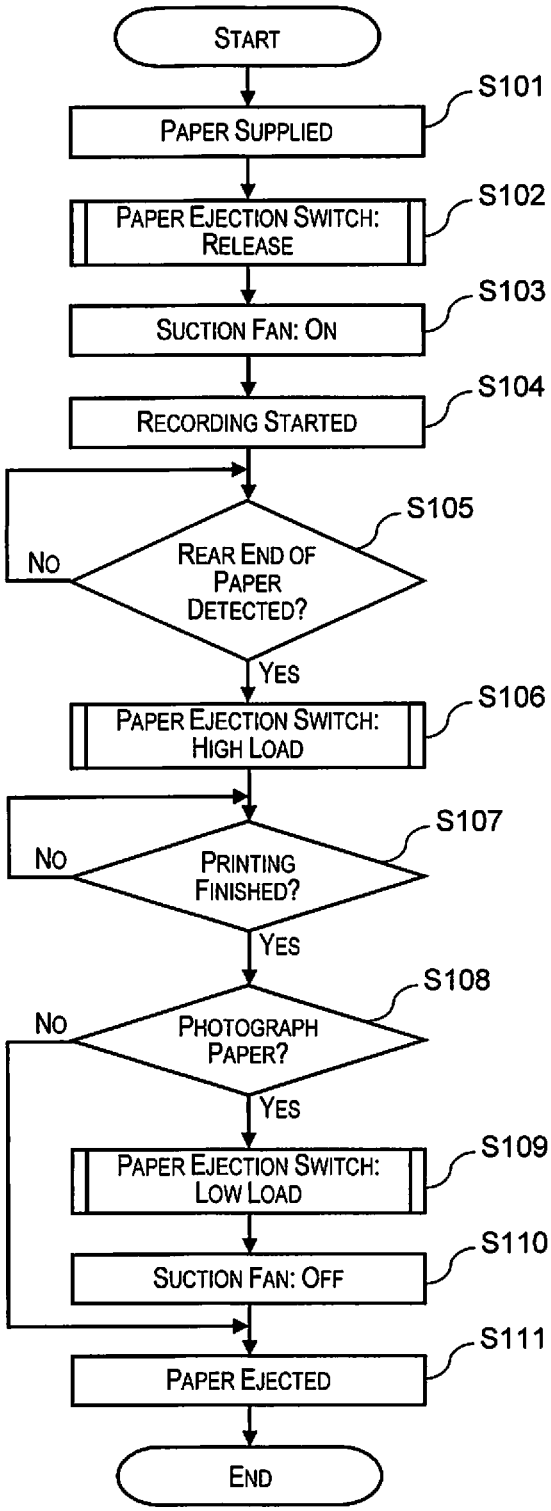
FIG. 6 is a flowchart showing the flow of switching the state of the first and second medium ejection unit.

Furthermore, FIG. 6 is a flowchart showing the flow of switching the states of the first medium ejection unit 30 and the second medium ejection unit 36. In FIG. 2, to make the disposed positions of the driven rollers (32*b*, 38*b*) easier to discern, the driven rollers are schematically depicted by being filled in black. FIGS. 3A to 5A show a roller pair disposed in the position shown by the symbol (a) in FIG. 2, and FIGS. 3B to 5B show a roller pair disposed in the position shown by the symbol (b) in FIG. 2. FIG. 2 is a drawing showing the high load selection mode corresponding to FIG. 3.

The overall configuration of the inkjet printer 1 is described hereinbelow. The inkjet printer 1 has a configuration comprising a paper supply device 2 at the bottom, wherein recording paper P as an example of the ejection medium or recording medium is fed out from a paper cassette 3 of the paper supply device 2, the paper is curved and inverted by an intermediate roller 12, and the paper is fed to an inkjet recording head 23, where recording is performed. A roll paper holder (not shown in FIG. 1) is provided to the rear of the recording device, and recording can also be performed on the roll paper unreeled from this roll paper holder.

The structural elements along the paper conveying route are described in further detail hereinbelow. The paper supply device 2 comprises the paper cassette 3, a pickup roller 11, an intermediate roller 12, a retarding roller 13, and guide rollers 14, 15.

The paper cassette 3, which can be removed from the device main body of the printer, is provided with edge guides 5, 6, and the side edge of the paper P is regulated by the edge guides 5 disposed on both sides of the paper in the paper feeding direction (the edge guide on the other side is not shown in the drawing). The edge guide 6 is an edge guide for regulating the rear end edge of the paper, and is provided to be capable of sliding in the paper feeding direction.

A separating member 7 having a separating inclined surface 7*a* is provided in a position facing the front end of the paper P accommodated in the paper cassette 3, and the front end of the paper P fed out by the pickup roller 11 is supplied downstream while sliding along the separating inclined surface 7*a*, thereby performing a preparatory separation of the top paper P to be supplied and the second and subsequent papers P being fed along with the top paper.

The pickup roller 11 is axially supported on a swinging member 9 capable of swinging in the clockwise and counterclockwise directions in FIG. 1 about a swinging shaft 9*a*, and is provided so as to be rotatably driven by the power of a drive motor (not shown). The pickup roller 11 rotates in contact with the top paper P accommodated in the paper cassette 3 when paper is being fed and thereby feeds the top paper P out from the paper cassette 3.

The paper P fed out from the paper cassette 3 enters a curving inverting section. This curving inverting section is provided with the intermediate roller 12, the retarding roller 13, and the guide rollers 14, 15.

The intermediate roller 12 is a large-diameter roller which forms the inner side of the curving inverting section for curving and inverting the paper P, and is rotatably driven by a drive motor (not shown). By rotating in the counterclockwise direction in FIG. 1, the intermediate roller 12 conveys the paper P downstream while winding the paper P.

The retarding roller 13 is provided to be capable of being pressed against and separated from the intermediate roller 12 while being subjected to a predetermined rotational friction resistance, and the retarding roller 13 separates the top paper P to be supplied from the second and subsequent papers P being fed along with the top paper by nipping the paper P with the intermediate roller 12.

The guide rollers 14, 15 are rollers capable of rotating freely, and between these, the guide roller 15 supplements the feeding of paper by the intermediate roller 12 by nipping the paper P with the intermediate roller 12.

Next, a conveying drive roller 19 and a conveying driven roller 20 are provided downstream of the intermediate roller 12. The conveying drive roller 19 is rotatably driven by a drive motor (not shown), and the conveying driven roller 20, which nips the paper P with the conveying drive roller 19, is driven to rotate along with the conveying of the paper P. A paper detector 17 is provided in the upstream vicinity of the conveying drive roller 19 and conveying driven roller 20, and this paper detector 17 makes it possible to detect whether the front end or the rear end of the paper is passing through.

Downstream of the conveying drive roller 19, an inkjet recording head 23 constituting liquid ejection unit or recording unit is disposed facing the paper conveying route. The inkjet recording head 23 is provided at the bottom of a carriage 22, and this carriage 22 is provided so as to receive the power of a drive motor (not shown) and move back and forth in a primary scanning direction (in the front-back direction of the image plane in FIG. 1). The symbol 24 indicates a guide shaft for guiding the carriage 22 in the primary scanning direction.

A first medium support member 25 which constitutes ejection medium support unit and supports the recording paper P is provided in a position facing the inkjet recording head 23 in the paper conveying route, downstream of which is provided a second medium support member 28, and the recording paper P is supported by these support members, whereby the gap between the recording surface and the inkjet recording head 23 is regulated.

The inkjet printer 1 is a large printer capable of recording on large paper up to a maximum size of A2, for example, and since the device is large in size, the first medium support member 25 is configured by two members (25R, 25L) in the paper width direction as shown in FIG. 2. The second medium support member 28 is similarly configured by two members (28R, 28L) in the paper width direction.

The reference position in the paper width direction when the paper P is conveyed is the right side in FIG. 2, and more ink absorption members 26 (ink-discarding grooves 25*a*) are provided to the first medium support member 25L provided on the left side of FIG. 2 than to the first medium support member 25R provided on the right side.

The ink-discarding grooves 25*a* are concavities for receiving ink that is discarded into areas separated from the ends of the paper when edgeless printing is performed on the ends of the recording paper P (the widthwise ends in the present embodiment), and are disposed at positions corresponding to the ends of the recording paper P of the size that is estimated in advance to be used. Therefore, a plurality of ink-discarding grooves 25*a* are formed along the paper width direction in the top surface of the first medium support member 25. A waste liquid tank (not shown) is provided in the bottom part of the first medium support member 25, and the ink discarded in the ink-discarding grooves 25*a* is discharged to the waste liquid tank through discharge holes (not shown) formed in the bottom surfaces of the ink-discarding grooves 25*a*.

A plurality of suction holes 25*c* are formed at suitable intervals along the paper width direction in the first medium support member 25. The suction holes 25*c* are connected to a fan device (not shown), and the operation of the fan device causes suction force to be applied to the reverse surface of the recording paper P and the recording paper P to be held by suction.

With the configuration used to handle roll paper in the inkjet printer 1 according to the present embodiment, the roll paper tends to be lifted off from the first medium support member 25 and the second medium support member 28 in accordance with the curling of the roll paper. Therefore, the top surface of the second medium support member 28 is disposed so as to be lower by a gap d than the top surface of the first medium support member 25, as shown in FIG. 3, to reduce the curling of the roll paper by this height difference, and to prevent or reduce the lifting of the roll paper from the first medium support member 25 and the second medium support member 28.

The first medium ejection unit 30 and the second medium ejection unit 36, composed of roller pairs, are provided downstream of the second medium support member 28, and the recording paper P having undergone recording is ejected by these medium ejection unit towards an ejected paper stacker 42. The ejected paper stacker 42 is provided to be capable of expanding and contracting, and FIG. 1 shows a contracted state.

The above description is of the overall configuration of the inkjet printer 1, and the first medium ejection unit 30 and second medium ejection unit 36 are described in detail hereinbelow with reference to FIGS. 2 through 7.

The first medium ejection unit 30 and the second medium ejection unit 36 are in general both configured from a drive roller rotatably driven by a motor (not shown), and a driven roller urged toward the drive roller by urging means (not shown).

More specifically, the symbol 31 in FIGS. 3A and 3B through FIGS. 5A and 5B indicates a first ejection drive roller, which is a drive roller belonging to the first medium ejection unit 30, and the symbol 37 indicates a second ejection drive roller, which is a drive roller belonging to the second medium ejection unit 36. These drive rollers are configured from rubber rollers, and a plurality of drive rollers are disposed at suitable intervals in the paper width direction (the left-right direction in FIG. 2).

The symbols 32A and 32B indicate driven rollers belonging to the first medium ejection unit 30, wherein the symbol 32A indicates a first high load roller as a "first driven roller," and the symbol 32B indicates a first low load roller as a "second driven roller" urged toward the first ejection drive roller 31 with a lower load than the first high load roller 32A.

Similarly, the symbols 38A and 38B indicate driven rollers belonging to the second medium ejection unit 36, wherein the symbol 38A indicates a second high load roller as a "first driven roller," and the symbol 38B indicates a second low load roller as a "second driven roller" urged toward the second ejection drive roller 37 with a lower load than the second high load roller 38A.

These driven rollers are all configured from metal toothed rollers having teeth in their external peripheries, and the driven rollers make pairs with the first ejection drive roller 31 and the second ejection drive roller 37, respectively, constituting roller pairs, whereby the recording paper P is nipped and conveyed and discharged downstream.

The first high load roller 32A and the first low load roller 32B in the first medium ejection unit 30 are supported on a swinging member 34 capable of swinging about a swinging shaft 35, and the swinging of the swinging member 34 makes it possible to select the roller that will be in contact with the first ejection drive roller 31.

Similarly in the second medium ejection unit 36, the second high load roller 38A and the second low load roller 38B are supported on a swinging member 39 capable of swinging about a swinging shaft 40, and the swinging of the swinging member 39 makes it possible to select the roller that will be in contact with the second ejection drive roller 37.

In FIGS. 3A and 3B through FIGS. 5A and 5B, the first medium ejection unit 30 is configured comprising a primary roller pair 30A having both a first high load roller 32A and a first low load roller 32B, and a secondary roller pair 30B having only a first high load roller 32A, wherein the primary roller pair 30A and the secondary roller pair 30B are disposed alternately along the paper width direction. The symbol (b) in FIG. 2 shows the position where the primary roller pair 30A is provided, and the symbol (a) shows the position where the secondary roller pair 30B is provided.

Similarly, the second medium ejection unit 36 is configured comprising a primary roller pair 36A having both a second high load roller 38A and a second low load roller 38B, and a secondary roller pair 36B having only a second high load roller 38A, wherein the primary roller pair 36A and the secondary roller pair 36B are disposed alternately along the paper width direction.

The first medium ejection unit 30 and the second medium ejection unit 36 configured as described above are capable of basically being put into a high-load selected state shown in FIGS. 3A and 3B, a low-load selected state shown in FIGS. 4A and 4B, and a release selected state shown in FIGS. 5A and 5B by a controller (not shown) for controlling a drive source (not shown) for driving the swinging shaft 35 and the swinging shaft 40. The swinging shaft 35 and the swinging shaft 40 do not need to be configured so as to swing in synchronization with each other, and in the present embodiment they are configured so as to be capable of swinging individually.

In the high-load selected state shown in FIGS. 3A and 3B, a first high load roller 32A of the first medium ejection unit 30 is provided for both the primary roller pair 30A and the secondary roller pair 30B, and a first high load roller 32A therefore comes in contact with all of the first ejection drive rollers 31 with a predetermined load. Similarly, in the second medium ejection unit 36, a second high load roller 38A comes in contact with all of the second ejection drive rollers 37 with a predetermined load.

However, in the low-load selected state shown in FIGS. 4A and 4B, a first low load roller 32B of the first medium ejection unit 30 is provided only to the primary roller pair 30A, and the first low load roller 32B therefore comes in contact with the first ejection drive roller 31 with a predetermined load across one gap in the paper width direction. Similarly, in the second medium ejection unit 36, a second low load roller 38B comes in contact with the second ejection drive roller 37 with a predetermined load across one gap in the paper width direction.

In the low-load selected state shown in FIGS. 4A and 4B, the first low load roller 32B of the first medium ejection unit 30 and the second low load roller 38B of the second medium ejection unit 36 are designed so as to come in contact with the other's drive roller at different positions along the paper width direction, so that their positions in the paper width direction do not coincide. Roller marks are thereby more reliably prevented from occurring on the paper recording surface during the low-load selected state.

In the release state shown in FIGS. 5A and 5B, all of the driven rollers are separated from their opposing drive rollers.

The following is a description, made with reference to FIG. 6, of the control before and after the rear end of the paper leaves the conveying drive roller 19 and the conveying driven roller 20 in the inkjet printer 1 having the configuration described above.

In FIG. 6, when the recording paper P is supplied (step S101), the first medium ejection unit 30 and the second medium ejection unit 36 are switched to the release state of FIGS. 5A and 5B (step S102), the paper suction by the suction holes 25*c* formed in the first medium support member 25 is turned on (step S103), and recording is begun in this state (step S104). Thus, in this state of initiating the start of recording, the driven rollers can be reliably prevented from damaging the paper recording surface because all of the driven rollers in the first medium ejection unit 30 and the second medium ejection unit 36 are separated from the drive roller.

Next, when the paper detector 17 (FIG. 1) detects that the rear end of the paper is passing through (Yes in step S105), the first medium ejection unit 30 and the second medium ejection unit 36 are switched to the high-load selected state in FIGS. 4A and 4B (step S106).

Specifically, when the rear end of the paper leaves the conveying drive roller 19 and the conveying driven roller 20 and recording is performed on the region at the rear end of the paper while the paper is being conveyed by the first medium ejection unit 30 and the second medium ejection unit 36, the recording paper P is nipped by the first medium ejection unit 30 and the second medium ejection unit 36 with a higher load than the low-load selected state. Conveying accuracy during recording on the region at the rear end of the paper is thereby guaranteed, and the appropriate recording quality can be achieved.

Next, when printing has finished (Yes in step S107), a determination is made as to whether or not the type of paper specified in the printer driver is photograph paper (glossy paper) (step S108), and when the paper is photograph paper (glossy paper) (Yes in step S108), the first medium ejection unit 30 and the second medium ejection unit 36 are switched to the low-load selected state of FIGS. 4A and 4B (step S109). This is the load-switching mode of the inkjet printer 1.

Next, the paper suction by the suction holes 25*c* formed in the first medium support member 25 is turned off (step S110), and with the paper conveying load reduced in this manner, paper ejection is reliably performed in the low-load selected state of the first medium ejection unit 30 and the second medium ejection unit 36 (step S111).

When the paper is not photograph paper (glossy paper) in step S108 (No in step S108), the first medium ejection unit 30 and the second medium ejection unit 36 are maintained in the high-load selected state of FIGS. 4A and 4B, and the paper is ejected in this state. This is the load-maintaining mode of the inkjet printer 1.

This is because, excluding cases in which the paper is photograph paper (glossy paper), roller marks are unlikely to be left in the recording surface of, for example, matte paper, regular paper, or other paper of low glossiness, even if it is photograph paper, and there are no problems even if the first medium ejection unit 30 and the second medium ejection unit 36 are still in the high-load selected state. Therefore, when the paper is not photograph paper (glossy paper), there is no need to switch the states of the first medium ejection unit 30 and the second medium ejection unit 36, and a high throughput can be achieved.

As described above, during rear end recording wherein recording is performed at least when the rear end of the paper has left the conveying unit (the conveying drive roller 19 and the conveying driven roller 20) and is being conveyed by the first medium ejection unit 30 and the second medium ejection unit 36, the first load (the high load) is selected for the first medium ejection unit 30 and the second medium ejection unit 36, and the second load (the low load) is selected after rear end recording is finished; therefore, the time during which the first load (the high load) is selected can be reduced, the recording quality during rear end recording can be maintained, and the formation of contact traces by the driven rollers of the first medium ejection unit 30 and the second medium ejection unit 36 on the paper recording surface can be suppressed to a minimum.

Since the load-switching mode and the load-maintaining mode are selected according to the type of paper, selecting the load-maintaining mode in accordance with the type of paper makes the load-switching action of the first medium ejection unit 30 and the second medium ejection unit 36 unnecessary and makes it possible to achieve a high throughput.

The switching from the high-load selected state to the low-load selected state (step S109) can be done simultaneously with both the first medium ejection unit 30 and the second medium ejection unit 36, but can also be done with different timings. It is thereby possible to avoid states in which the recording paper is not nipped by either the first medium ejection unit 30 or the second medium ejection unit 36, and to prevent the resulting inconvenience of the rear end of the paper rising upward and coming in contact with the inkjet recording head 23.

At this time, it is also useful to switch the load selected state of the first medium ejection unit 30 first. By so doing, when the second medium ejection unit 36, which is farther from the inkjet recording head 23, is in the second load (the low load), it is possible to avoid situations in which the recording paper is nipped only by the second medium ejection unit 36. It is thereby possible to prevent the inconvenience of the rear end of the paper rising upward and coming in contact with the inkjet recording head 23.

In the present embodiment, a serial liquid ejection device, i.e., a liquid ejection device which performs recording while an inkjet recording head 23 moves in the paper width direction, was described as an example of the inkjet printer 1, but needless to say, the inkjet printer 1 is not limited to this device, and the present invention can also be applied to, for example, a so-called line head liquid ejection device in which the recording head is provided as being fixed in place.

The term "liquid ejection device" is used with a meaning that is not limited to printers, transfer devices, fax machines, or other recording devices that use inkjet recording heads and discharge ink from the recording heads to perform recording on a recording medium, but which also includes devices wherein a liquid corresponding to the application is ejected instead of ink from a liquid ejection head equivalent to the recording head onto an ejection medium (conveyed member) equivalent to the recording member, and the liquid is deposited on the ejection medium.

Other than the recording head, possible examples of the liquid ejection head include a color material ejection head used in the manufacture of a liquid crystal display or another color filter; an electrode material (electroconductive paste) ejection head used to form electrodes in an organic EL display, a surface-emitting display (FED), or the like; a biological organic ejection head used in the manufacture of biochips; a specimen ejection head as a precision pipette; and the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording method for recording apparatus including a recording unit configured to perform recording on a recording medium, a conveying unit configured to convey the recording medium, an ejection unit configured to eject the recording medium on which recording has been performed, the ejection unit having a drive roller and a driven roller urged toward the drive roller, the recording method comprising:

performing the recording on the recording medium;

ejecting the recording medium by the driven roller and the drive roller;

separating the driven roller from the drive roller during the recording until a rear end of the recording medium leaves the conveying unit:, urging the driven roller toward the drive roller by a first load to eject the recording medium while the recording is performed on the recording medium of which the rear end has left the conveying unit;

determining whether or not the recording is finished while the driven roller is urged toward the drive roller by the first load;

switching the first load to a second load by which the driven roller is urged toward the drive roller to eject the recording medium on which the recording is finished in response to determining that the recording is finished, the second load being less than the first load; and urging the driven roller toward the drive roller by the second load while ejecting the recording medium on which the recording is finished.

2. The recording method according to claim 1, wherein the first load is a load by which the ejection unit conveys the recording medium, and the second load is a load by which the driven roller and the drive roller nip the recording medium.

3. The recording method according to claim 1, wherein the recording apparatus includes a suction hole for applying suction force to the recording medium, and the recording method further comprises depressing the suction force while the driven roller is urged toward the drive roller by the second load in comparison with the suction force while the driven roller is urged toward the drive roller by the first load.

4. A recording method for recording apparatus including a recording unit configured to perform recording on a recording medium, a conveying unit configured to convey the recording medium, an ejection unit configured to eject the recording medium on which recording has been performed, the ejection unit having a drive roller and a driven roller urged toward the drive roller, the recording method comprising:

urging the driven roller toward the drive roller by a first load while the recording is performed on the recording medium and after a rear end of the recording medium has left the conveying unit;

switching the first load to a second load that is less than the first load to urge the driven roller toward the drive roller by the second load after the recording is finished; and ejecting the recording medium by urging the driven roller toward the drive roller by the second load, the ejection unit including a first roller group including a plurality of driven rollers disposed at prescribed intervals along a direction orthogonal to a conveying direction, and a second roller group including a plurality of driven rollers disposed at prescribed intervals along the direction orthogonal to the conveying direction, the second roller group being provided downstream of the first roller group, and the recording method further comprising disposing the driven rollers of the first roller group and the driven rollers of the second roller group alternately along the direction orthogonal to the conveying direction when the driven rollers are urged toward the drive roller by the second load, and disposing the driven rollers of the first roller group and the driven rollers of the second roller group so as to be aligned with respect to each other in the conveying direction when the driven rollers are urged toward the drive roller by the first load.

5. A recording method for recording apparatus including a recording unit configured to perform recording on a recording medium, a conveying unit configured to convey the recording medium, an ejection unit configured to eject the recording medium on which recording has been performed, the ejection unit having a drive roller and a driven roller urged toward the drive roller, the recording method comprising:

urging the driven roller toward the drive roller by a first load while the recording is performed on the recording medium and after a rear end of the recording medium has left the conveying unit, switching the first load to a second-load that is less than the first load to urge the driven roller toward the drive roller by the second load after the recording is finished, and ejecting the recording medium by the urging the driven roller toward the drive roller by the second load, the driven roller including a first driven roller urged by the first load and a second driven roller urged by the second load, the ejection unit including a first roller group including a primary roller unit and a secondary roller unit disposed sequentially in prescribed intervals along a direction orthogonal to a conveying direction, the primary roller unit having the first driven roller and the second driven roller, the secondary roller unit having only the first driven roller, and a second roller group provided downstream of the first roller group and including the primary roller unit and the secondary roller unit disposed sequentially in prescribed intervals along the direction orthogonal to the conveying direction, and the recording method further comprising disposing the second driven roller of the first roller group and the second driven roller of the second roller group alternately along the direction orthogonal to the conveying direction when the second driven roller being urged toward the drive roller by the second load.

6. The recording method according to claim 5, wherein one of the second driven roller of the first roller group and the second driven roller of the second roller group is switched first when the first-load is switched to the second-load.

7. The recording method according to claim 6, wherein the second driven roller of the first roller group is switched first when the first-load is switched to the second-load.

* * * * *